US008697969B2

(12) United States Patent
van Ekstrom

(10) Patent No.: US 8,697,969 B2
(45) Date of Patent: Apr. 15, 2014

(54) TREMOLO ASSEMBLY

(75) Inventor: Gordon van Ekstrom, Kirkland, WA (US)

(73) Assignee: GDK Technologies, Inc., Coeur D'Alene, ID (US)

( * ) Notice: Subject to any disclaimer, the term of this patent is extended or adjusted under 35 U.S.C. 154(b) by 93 days.

(21) Appl. No.: 13/308,434

(22) Filed: Nov. 30, 2011

(65) Prior Publication Data

US 2012/0137851 A1 Jun. 7, 2012

Related U.S. Application Data

(60) Provisional application No. 61/418,544, filed on Dec. 1, 2010.

(51) Int. Cl.
*G10D 3/00* (2006.01)

(52) U.S. Cl.
USPC ..... 84/313

(58) Field of Classification Search
USPC ..... 84/313; D17/20
See application file for complete search history.

(56) References Cited

U.S. PATENT DOCUMENTS 3,290,980 A 12/1966 Fender
4,171,661 A * 10/1979 Rose ..... 84/313
4,497,236 A 2/1985 Rose
4,549,461 A 10/1985 Rose
4,555,970 A 12/1985 Rose
4,604,936 A * 8/1986 Page et al. ..... 84/313
4,681,010 A 7/1987 Wilkinson
4,811,646 A 3/1989 Hoshino
4,882,967 A 11/1989 Rose
4,967,631 A 11/1990 Rose
5,252,777 A 10/1993 Allen
5,522,299 A 6/1996 Rose
5,537,907 A 7/1996 Rose
5,539,143 A 7/1996 Rose
5,589,653 A 12/1996 Rose
5,684,256 A 11/1997 Rose
5,689,075 A 11/1997 Rose
5,696,335 A 12/1997 Rose
5,700,965 A 12/1997 Rose
5,705,760 A 1/1998 Rose
5,717,150 A 2/1998 Rose
5,929,362 A 7/1999 Oteyza
5,945,615 A 8/1999 Rose
6,046,393 A 4/2000 Rose
6,046,397 A 4/2000 Rose
6,051,773 A 4/2000 Rose
6,137,039 A 10/2000 Rose
6,194,645 B1 2/2001 Rose
7,009,096 B2 * 3/2006 Hirayama ..... 84/313
7,045,693 B2 5/2006 Rose et al.
7,442,865 B2 10/2008 Moghaddam
7,538,269 B2 5/2009 Ekstrom (Continued)

*Primary Examiner* — Jianchun Qin

(57) ABSTRACT

A bridge assembly having a saddle plate, a tremolo block, and a bushing extending through the saddle plate and tremolo block. The bushing has an internal bore, and an engagement member extends through the bushing and is partially disposed in the internal bore. A tremolo arm has an engagement section with a flat engagement surface that defines a plane substantially parallel to a longitudinal axis of the engagement section. The engagement member is perpendicular to and laterally disposed from the internal bore's longitudinal axis. The engagement member frictionally engages the flat engagement surface when the engagement section is disposed in the internal bore. The tremolo arm's engagement section rotates with the busing as a unit relative to the tremolo block.

20 Claims, 13 Drawing Sheets

(56) References Cited

U.S. PATENT DOCUMENTS 7,838,758 B2 11/2010 van Ekstrom
8,207,433 B1 * 6/2012 Maiorana ..... 84/313
8,283,552 B2 10/2012 van Ekstrom
<2004/0074373 A1 * 4/2004 Goto ..... 84/452 R

* cited by examiner

TREMOLO ASSEMBLY

CROSS-REFERENCE TO RELATED APPLICATIONS

This non-provisional patent application hereby claims priority to and fully incorporates by reference U.S. Provisional Patent Application No. 61/418,544, titled TREMOLO ASSEMBLY and filed Dec. 1, 2010.

TECHNICAL FIELD

Embodiments of the present invention are directed to tremolos for stringed instruments.

BACKGROUND

Stringed instruments, such as electric guitars have incorporated devices to vary the tension of the strings to change the pitch of the strings. One such tool is a conventional tremolo and a bridge assembly, wherein the tremolo can be moved while a musician is playing the instrument to change the pitch of the strings. Many conventional tremolo arms, however, are rotatable attached to the bridge by screwing the end of the tremolo arm into a threaded hole in the bridge assembly. Over time and through use, the threads on the tremolo arm and the bridge assembly wear, and the tremolo loosens and develops excessive travel or "slop" during use. The process of screwing the tremolo arm into the place can be slow or inconvenient. Accordingly, there is a need for an improved tremolo system.

SUMMARY

The present invention provides a tremolo assembly that overcome drawbacks experienced in the prior art. In one embodiment, the tremolo assembly is configured to be used with an electric guitar or other suitable stringed musical instrument. The assembly of at least one embodiment includes a tremolo arm removeably coupled to a saddle plate, a tremolo block and a bushing. The tremolo arm has a non-threaded engagement section configured to be quickly and easily inserted into the bushing and retained in place without having to screw the tremolo arm into position. The tremolo arm can also be easily and quickly removed from the bushing when the tremolo arm is not needed. The bushing is rotatably mounted in the tremolo block. The tremolo arm and the bushing are configured to rotate as a unit relative to the tremolo block, thereby allowing the musician to swing or otherwise move the tremolo arm to a desired position for manipulation to change the pitch of the guitar strings while playing. In one embodiment, the tremolo assembly is mounted to an electric guitar and is configured to allow a musician to change the pitch of the guitar strings, such as to create a vibrato, while playing by adjusting the tremolo arm. Other embodiments include the tremolo assembly mounted to other stringed musical instruments. The tremolo assembly provides better control and accuracy for the musician for creating a vibrato or otherwise changing the pitch of the strings while playing.

DETAILED DESCRIPTION

The present disclosure describes a tremolo assembly in accordance with certain embodiments of the present invention. Several specific details of the invention are set forth in the following description and FIGS. 1-13 to provide a thorough understanding of certain embodiments of the invention. One skilled in the art, however, will understand that the present invention may have additional embodiments, and that other embodiments of the invention may be practiced without several of the specific features described below.

Figure 1:
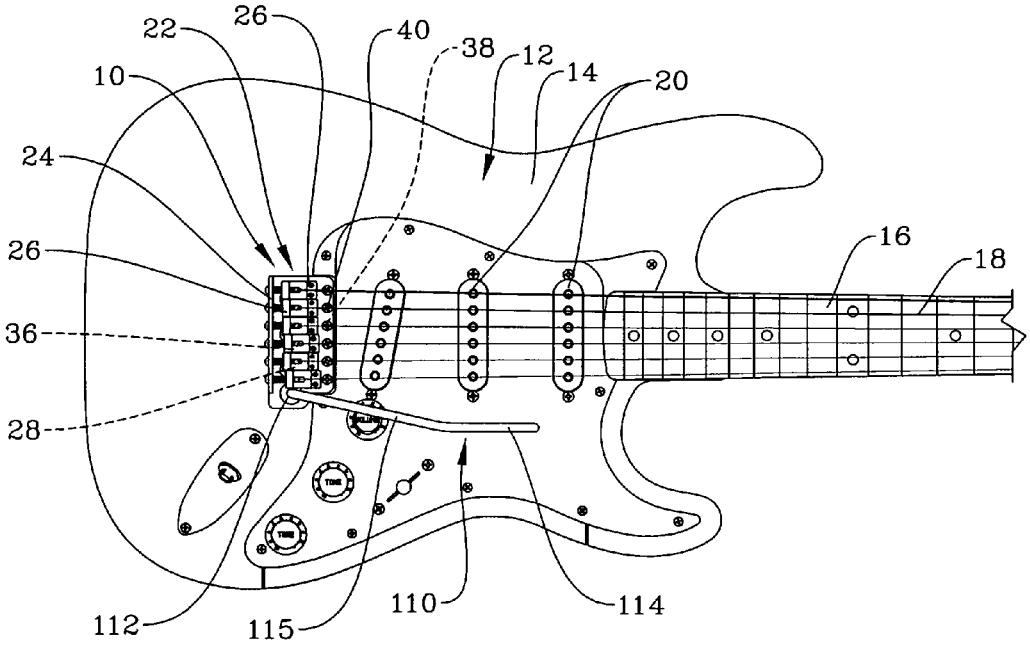
FIG. 1 is a front isometric view of an electric guitar with a tremolo assembly in accordance with an embodiment of the present invention, wherein the tremolo arm is oriented in a raised, playing position.
Figure 13:
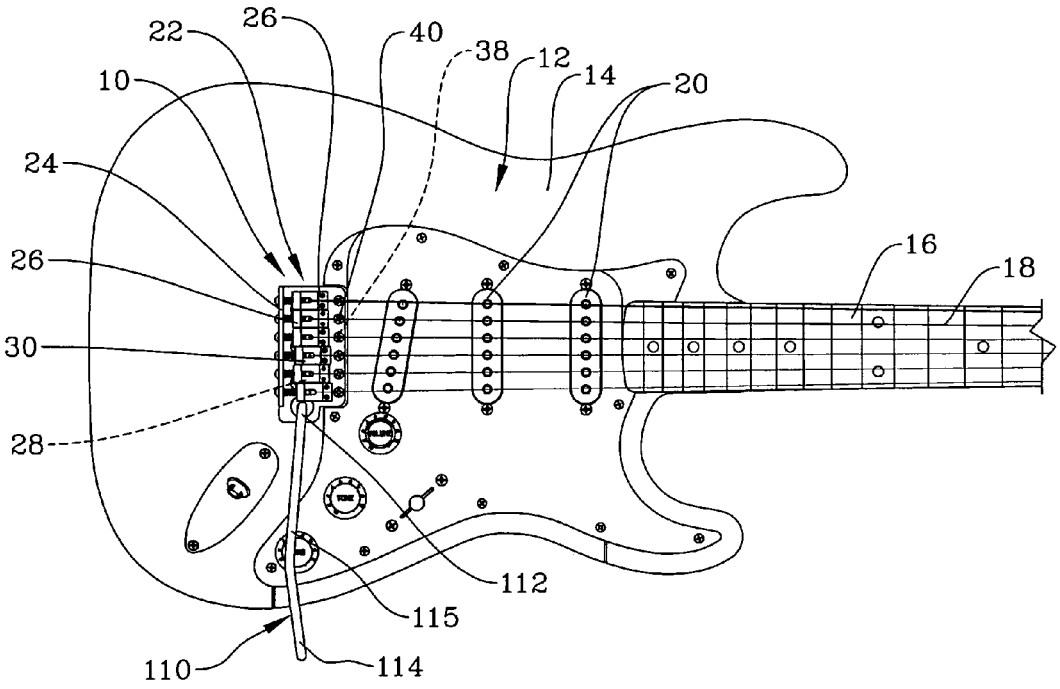
FIG. 13 is a front isometric view of the electric guitar of FIG. 1 with the tremolo assembly rotated to a lowered, inactive position.

Embodiments of the present inventions include the tremolo assembly 10 mountable to an electric guitar 12, shown in FIGS. 1 and 13, that has a body 14, a neck 16, strings 18, a series of pickups 20, and other conventional components of an electric guitar. The tremolo assembly 10 includes a bridge assembly 22 mounted to the guitar body 14. The bridge assembly 22 includes a saddle plate 24 that attaches to the guitar body 14 and that has a plurality of saddle assemblies 26 positioned to support a distal portion of the guitar strings 18. The saddle plate 24 is mounted to a bridge block 28 that anchor the distal ends of the guitar strings 18.

Figure 2:
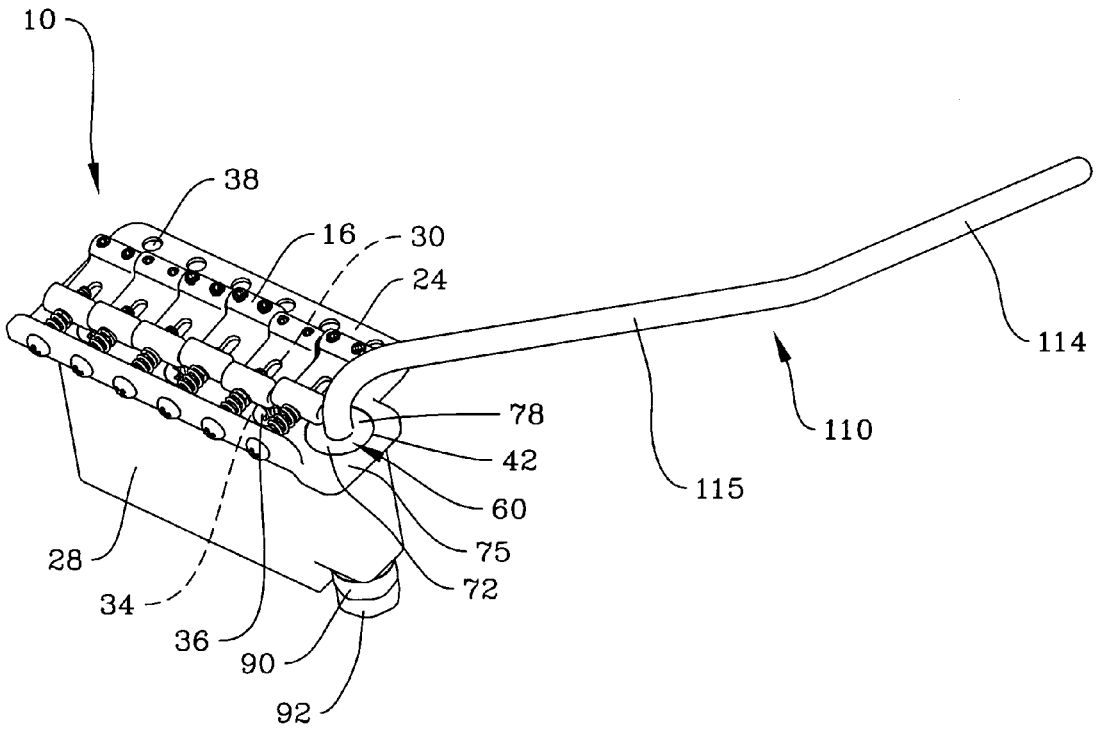
FIG. 2 is an enlarged top isometric view of the tremolo assembly shown removed from the guitar of FIG. 1.
Figure 3:
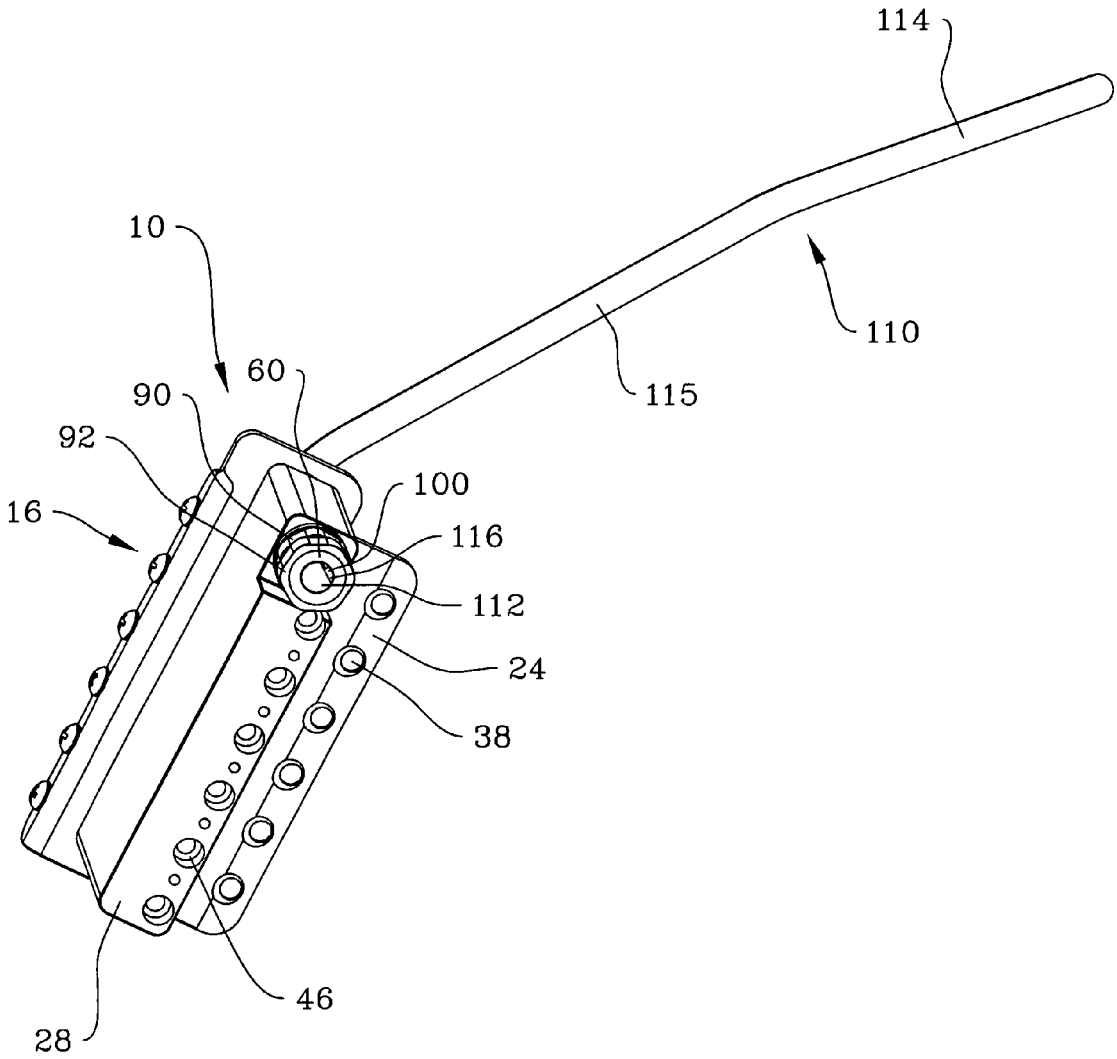
FIG. 3 is a bottom isometric view of the tremolo assembly of FIG. 2.
Figure 4:
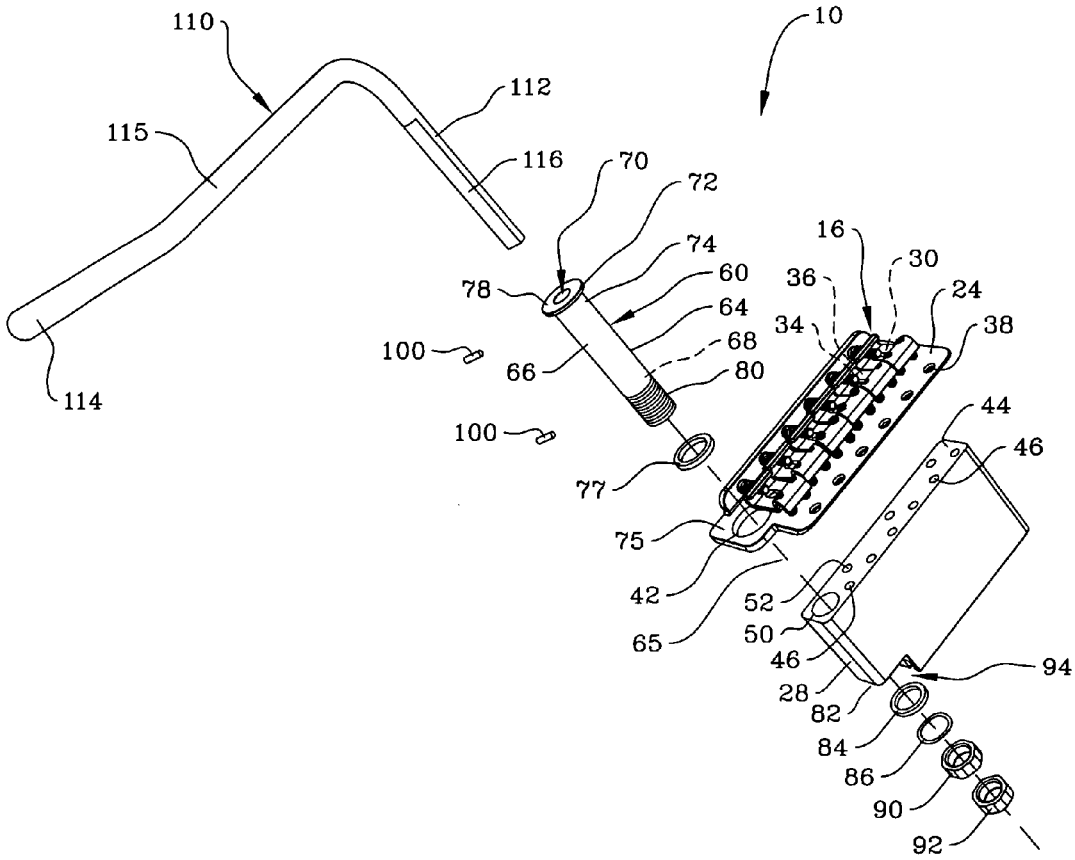
FIG. 4 is a partially exploded top isometric view of the tremolo assembly of FIG. 2.
Figure 5:
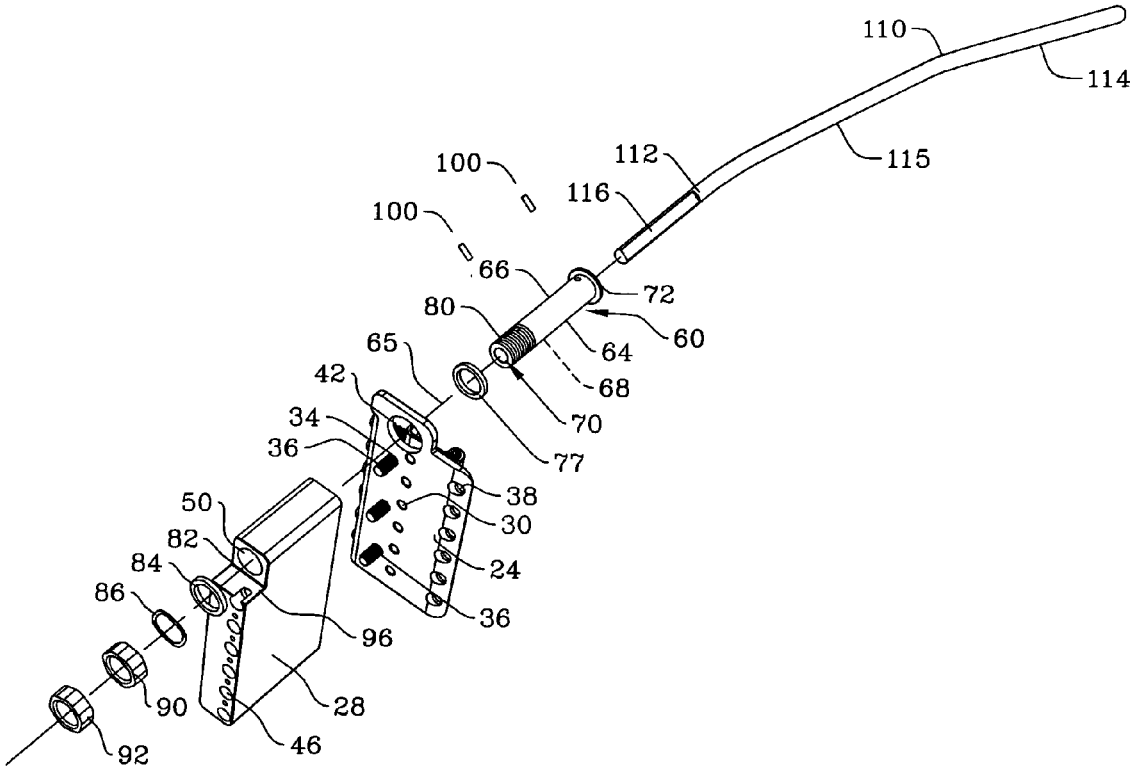
FIG. 5 is a partially exploded bottom isometric view of the tremolo assembly of FIG. 2.

FIG. 2 is an enlarged top isometric view of the tremolo assembly 10 shown removed from the guitar 12. FIG. 3 is a bottom isometric view of the tremolo assembly 10. FIG. 4 is a partially exploded top isometric view of the tremolo assembly 10, and FIG. 5 is a partially exploded bottom isometric view of the tremolo assembly 10. The saddle plate 24 of the illustrated embodiment has a set of string apertures 30, and the conventional saddle assemblies 16 are mounted over the string apertures 30. The saddle plate 24 has fastening apertures 34 that receive fasteners 36 (FIG. 5) that mount to the tremolo block 28. Mounting aperture 38 receive fasteners 40 (FIG. 1) to mount to the guitar body 14 (FIG. 1), and a tremolo aperture 42 through which a portion of a tremolo bushing 60 extends.

The tremolo block 28 of the illustrated embodiment is a block of metal, such as steel, titanium, alloy, or suitable material. The tremolo block of other embodiments can be other materials with suitable strength and acoustic properties. The tremolo block 28 has a flat top surface 44 that engages and supports the saddle plate 24. The tremolo block 28 has a plurality of string apertures 46 coaxially aligned with the string apertures 30 in the saddle plate 24. The tremolo block 28 also has a tremolo aperture 50 coaxially aligned with the tremolo aperture 42 in the saddle plate 24. The tremolo block 28 has fastener apertures 52 coaxially aligned with the fastening apertures 34 in the saddle plate 24. In the illustrated embodiment, three threaded fasteners 36 (e.g. screws) extend through the fastening apertures 34 in the saddle plate and screw into the fastener apertures 52 in the tremolo block 28. The fasteners 36 secure the saddle plate 24 in fixed engagement with the flat top surface 44 of the tremolo block 28. The tremolo block 28 and the string apertures 46 are configured so the strings 18 (FIG. 1) extend through block and through the string apertures 30 in the saddle plate, while the distal ends of the guitar strings are anchored in or on the bottom portion of the tremolo block.

The tremolo assembly 10 has a bushing 60 rotatably mounted in the aligned tremolo apertures 42 and 50 of the saddle plate 24 and tremolo block, respectively. The bushing 60 of the illustrated embodiment is a hollow, substantially cylindrical member with sidewalls 64 having a smooth exterior surface 66 and a smooth interior surface 68 that defines an interior bore 70 coaxially aligned with the bushing's longitudinal axis 65. The bushing 60 has a flange 72 extending radially from the bushing's upper end 74 and configured to be rotatably received in the saddle plate's tremolo aperture 42. In the illustrated embodiment, the upper surface 75 of the saddle plate 24 is substantially flush or coplanar with bushing's flange 72. The tremolo aperture 42 has a diameter slightly larger than the outer diameter of the flange 72 so the bushing will fit closely in the saddle plate 24 while still being able to freely rotate (as discussed in greater detail below). The illustrated embodiment also has a Teflon washer 77 on the upper portion of the bushing just under the flange 72, so the Teflon washer 77 is sandwiched between the flange 72 and the tremolo block 28. The Teflon washer 77 allows the bushing 60 and the flange 72 to rotate in the saddle plate 24 relative to the tremolo block. Although the illustrated embodiment has a washer made of Teflon, other lubricious material can be used. In other embodiments, the washer need not be used. The flange 72 and/or the tremolo block 28 can include a lubricious coating if needed to facilitate free rotation of the bushing relative to the saddle plate 24. In the illustrated embodiment, the saddle plate 24 has a thickness substantially equal to the thickness of the flange 72 and the washer 77, so the upper surface 78 of the flange 72 is substantially coplanar (i.e., flush) with the surface 75 of the saddle plate 24. While flange 72 in the illustrated embodiment is recessed within the saddle plate 24, the flange need not be recessed in all embodiments. In an alternate embodiment, the saddle plate 24 and the bushing 60 can be configured so the saddle plate is sandwiched between the bushing's flange 72 and the upper surface of the tremolo block.

In the illustrated embodiment, the bushing 60 is rotatably carried by the tremolo block 28 within the tremolo aperture 50. The outer diameter of bushing's sidewalls 64 is slightly smaller than the inner diameter of the block's tremolo aperture 50. Accordingly, the bushing 60 can freely rotate within the tremolo block 28, but is substantially prevented from moving laterally within the block.

The bushing 60 of the illustrated embodiment has a threaded bottom end 80 opposite the flange 72. The bushing 60 extends through the entire tremolo block, and the bushing's threaded bottom end 80 extends past the bottom portion 82 of the tremolo block 28.

The tremolo assembly 10 has a Teflon washer 84 positioned on the threaded bottom end 80 of the bushing 60 and in direct engagement with the bottom portion 82 of the tremolo block 28. Although, the illustrated embodiment uses a washer made of Teflon, other embodiments can use other materials that are suitably lubricious to allow the bushing to freely rotate within the bushing. A spring washer 86 is positioned on the threaded bottom end 80 of the bushing 60 next to the Teflon washer 84, with the Teflon washer sandwiched between the tremolo block 28 and the spring washer 86. Two locking nuts 90 and 92 are screwed onto the threaded bottom end 80 of the bushing 60 immediately next to each other, with the spring washer 86 sandwiched between the upper most nut 90 and the Teflon washer 84. The upper nut 90 is screwed onto the bushing's threaded bottom end 80 so as to slightly compress the spring washer 86 against the Teflon washer 84, so that the bushing 60 is held firmly within the tremolo block 28 and substantially restricted from moving axially within the tremolo aperture 50. The upper nut 90, however, is tightened only enough to hold the bushing 60 in place while still allowing the bushing to substantially freely rotate within the bushing. The lower locking nut 92 is tightened firmly against the upper locking nut 90 so as to secure the upper nut in a fixed position on the bushing, thereby forming a double nut locking system to securely hold the bushing in position in the tremolo block while insuring the bushing can rotate within the block 28.

In the illustrated embodiment, the Teflon washer 84 is immediately adjacent to the bottom portion 82 of the tremolo block 28. In an alternate embodiment, the spring washer 86 is positioned on the threaded bottom end 80 of the bushing 60 immediately adjacent to or in engagement with the bottom portion 82 of the tremolo block 28. The Teflon washer 84 is sandwiched between the spring washer 86 and the upper most nut 90. Accordingly, the sequential order in this alternate embodiment is the tremolo block 28, the spring washer 86, the Teflon washer 84, the upper nut 90 and the lower locking nut 92. This alternate configuration can provide a different feel to the tremolo assembly, such as the feel of the tremolo arm and tremolo block movement, which may be preferred by some musicians.

Figure 6:
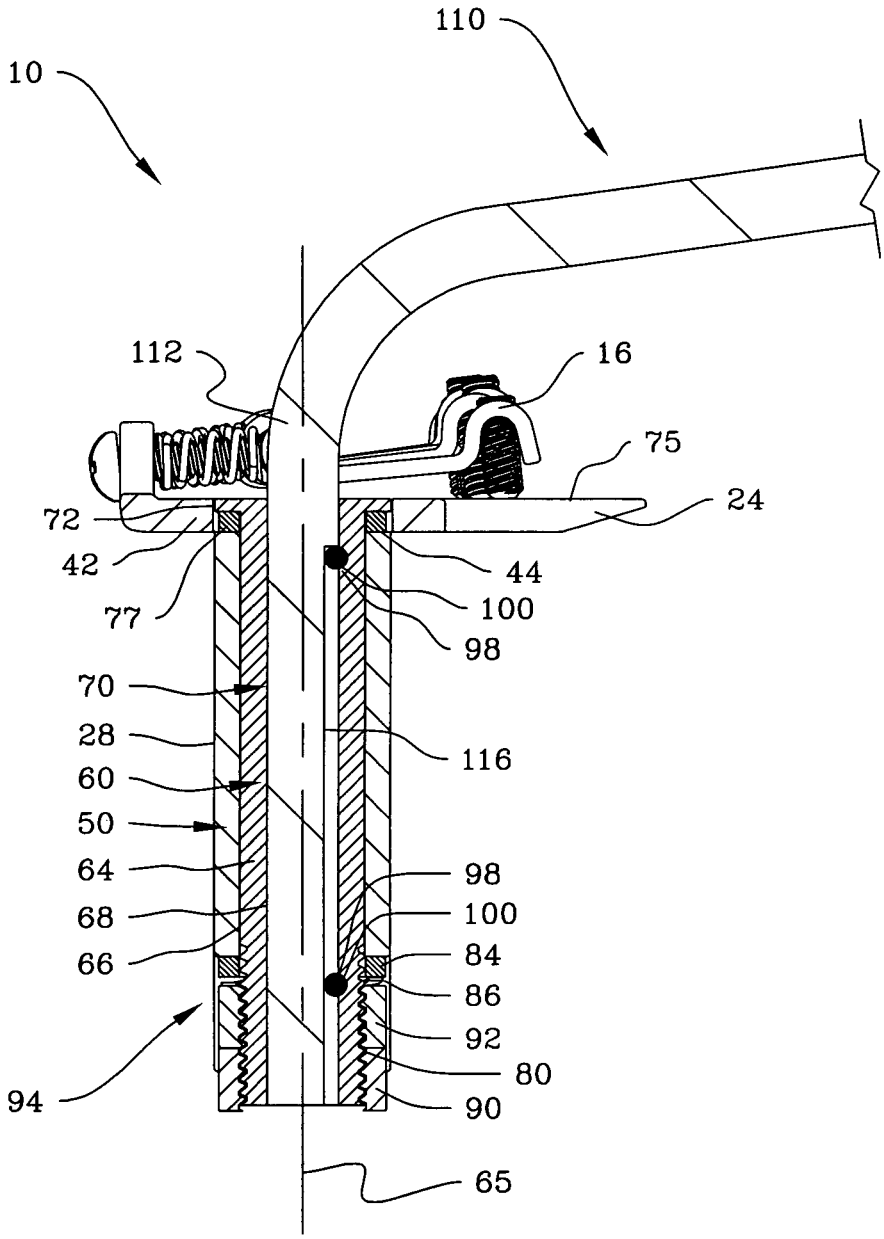
FIG. 6 is an enlarged partial side elevation view of the tremolo assembly of FIG. 2.
Figure 7:
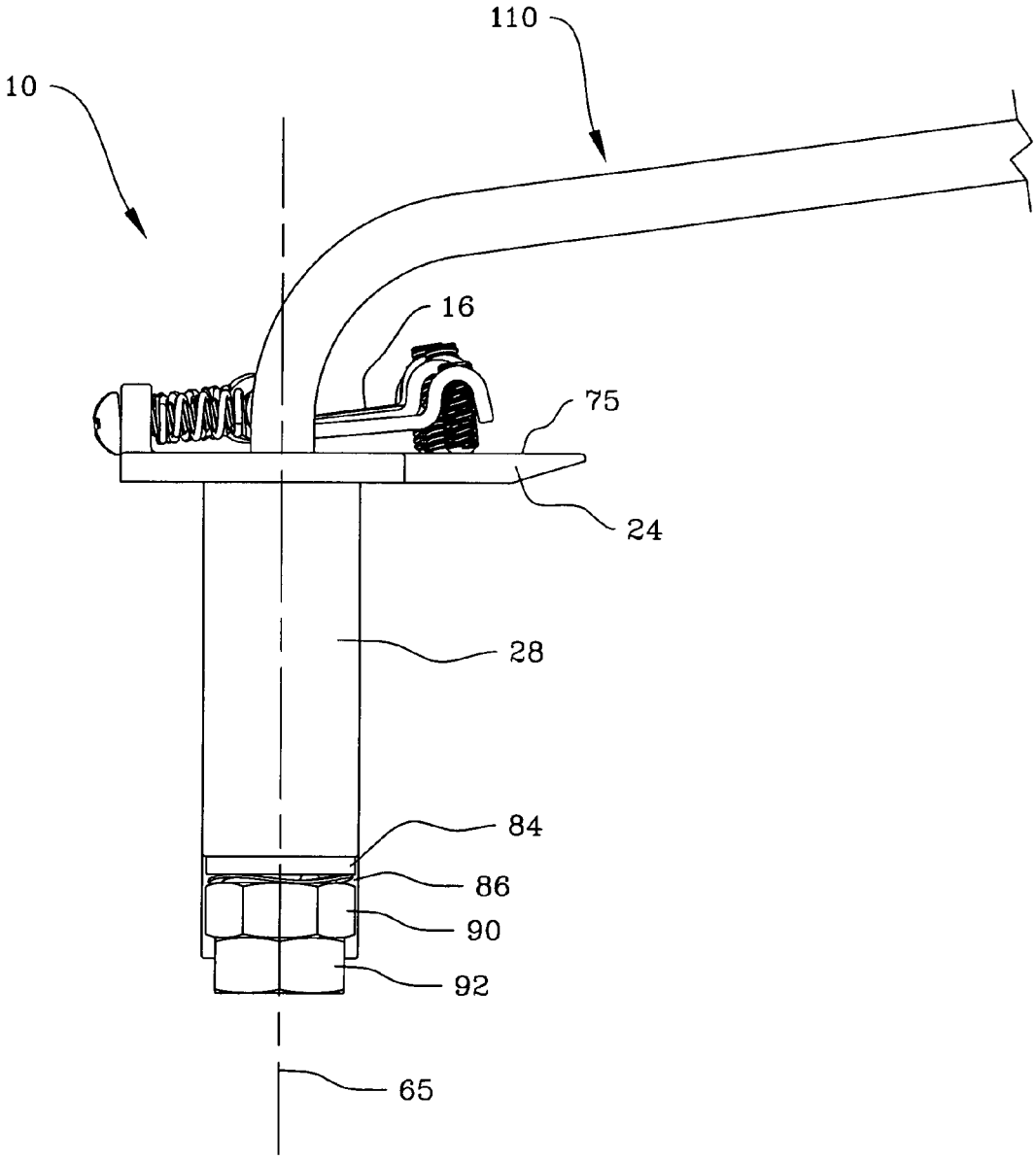
FIG. 7 is an enlarged cross-sectional view of the tremolo assembly taken substantially along line 7-7 of FIG. 4.

As seen in FIGS. 4-6, the bottom portion 82 of the tremolo block 28 adjacent to the tremolo aperture 50 has a recessed portion 94 sized and positioned to receive the washers 84 and 86 and the locking nuts 90 and 92. Accordingly, the washers and locking nuts are at least partially recessed relative to the end of the tremolo block. The bushing 60 and the recessed portion 94 of the illustrated embodiment are sized so the bushing's threaded bottom end 80 and the locking nuts 90 and 92 are approximately coplanar with the bushing bottom portion. Accordingly, the tremolo block 28, the bushing 60 and the locking nuts 90 and 92 are recessed within the body of the guitar 12 (FIG. 1), and do not stick out past the back surface of the guitar body 14 (FIG. 1). In other embodiments, however, the tremolo block 28, the bushing 60 and the locking nuts 90 and 92 can be other sizes as desired.

Figure 8:
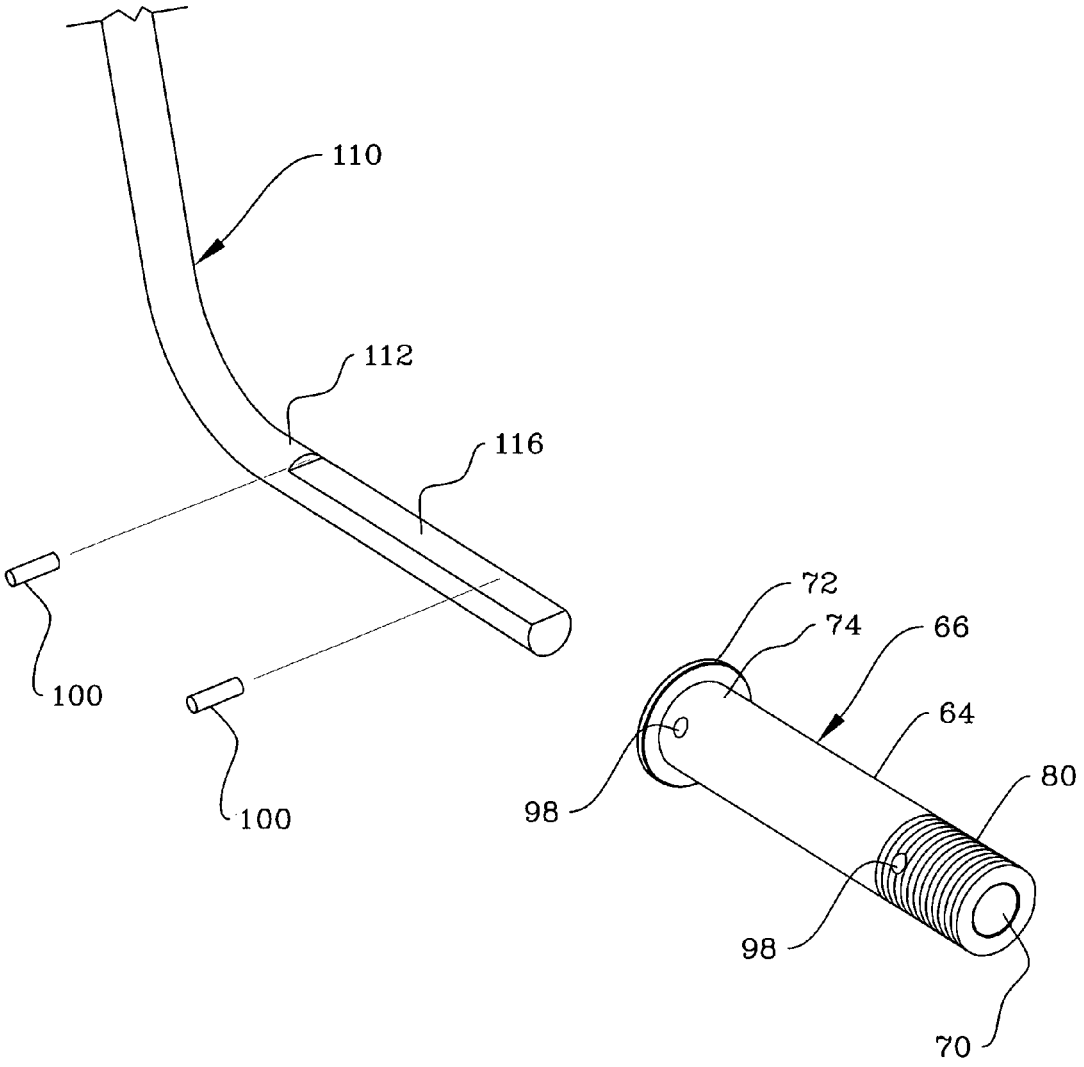
FIGS. 8 and 9 are partially exploded isometric views of a tremolo arm, bushing and engagement pins shown removed from the remainder of the tremolo assembly of FIG. 6.
Figure 9:
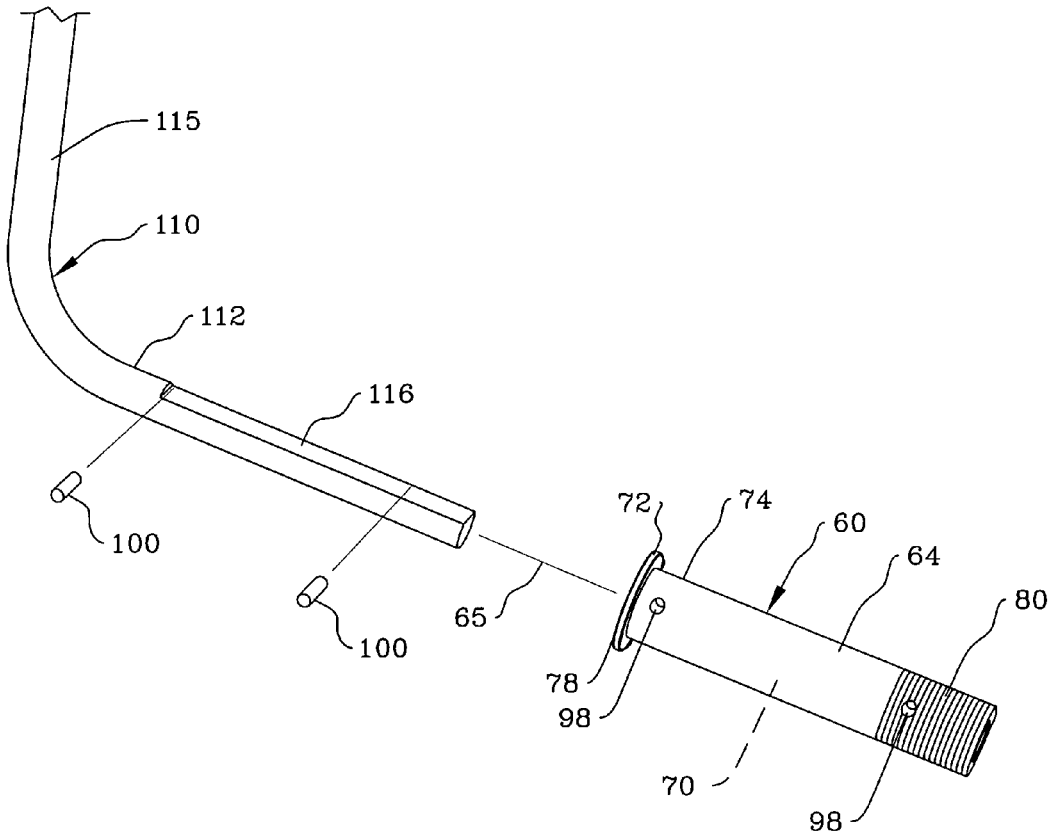
Figure 10:
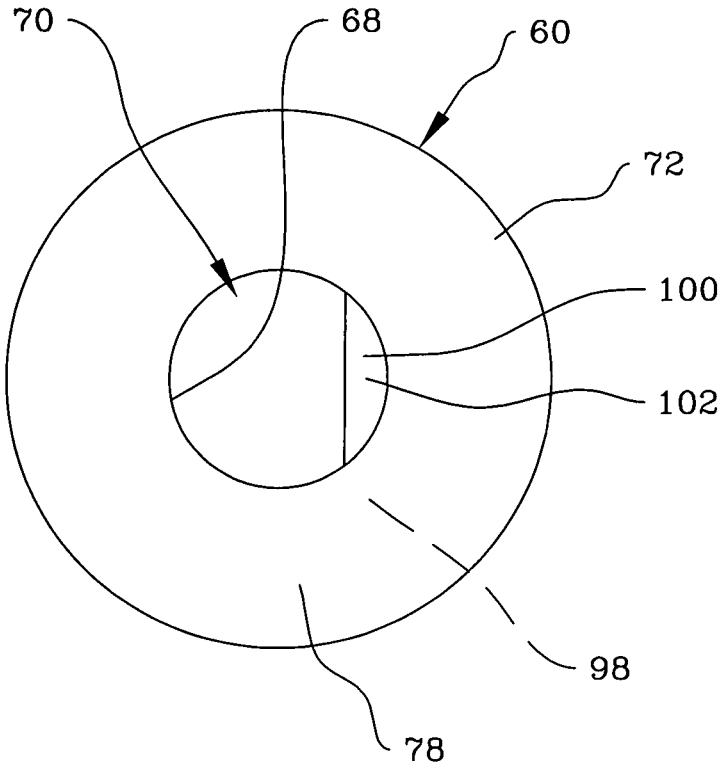
FIG. 10 is a top plan view of the bushing and engagement pins separated from the remainder of the tremolo assembly of FIG. 6.
Figure 11:
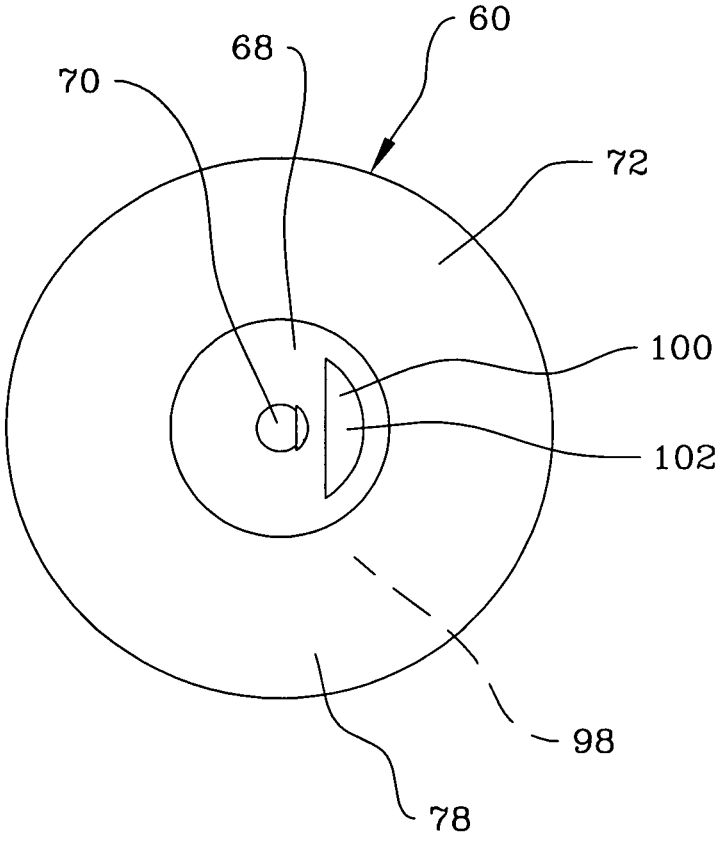
FIG. 11 is a top perspective of the view of the bushing and engagement pins of FIG. 10.
Figure 12:
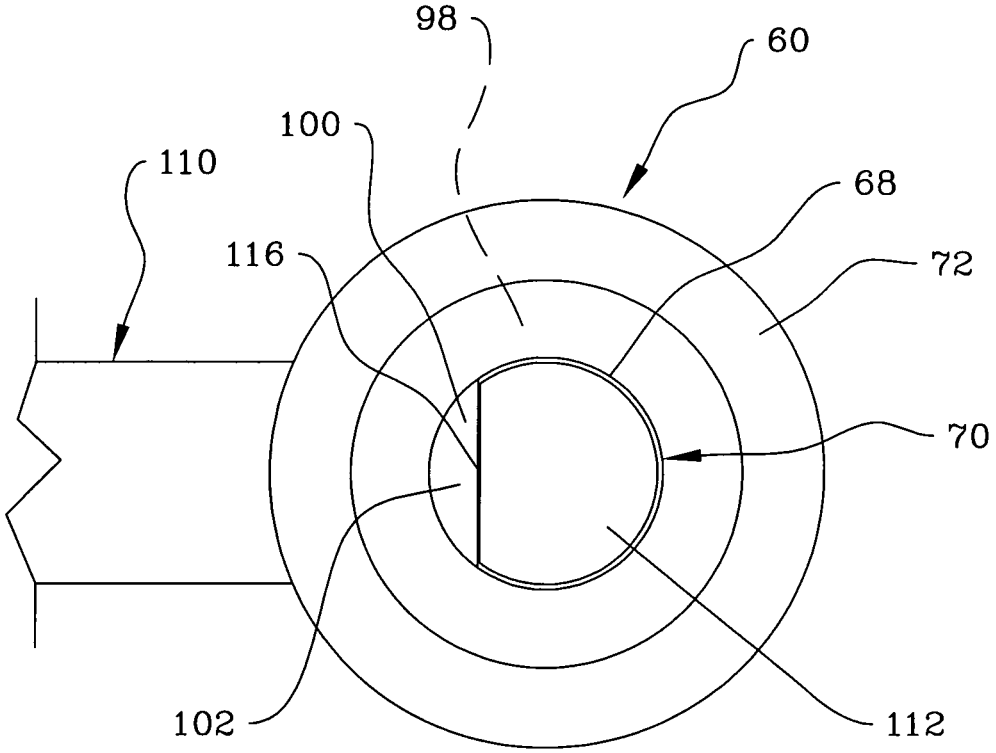
FIG. 12 is a bottom perspective of the view of the bushing and engagement pins of FIG. 11 with the tremolo arm shown installed in the bushing.

As best seen in FIGS. 6, 8 and 9, the bushing 60 has a pair of pin apertures 98 extending through the sidewalls 64. The pin apertures 98 of the illustrated embodiment are spaced apart and parallel to each other, and the apertures are substantially transverse (i.e., perpendicular) to the longitudinal axis 65 of the bushing 60. In addition, the pin apertures are laterally disposed from the bushing's longitudinal axis, while still extending across a side portion of the bushing's interior bore 70. As seen in FIGS. 10-12, the engagement pins 100 are positioned in the pin apertures 98, such that middle portions 102 of the pins extend across the side portion of the bushing's interior bore 70. The engagement pins 100 are fixed within the pin apertures 98 so they are prevented from being removed without the use of a tool for removal. In one embodiment, the engagement pins 100 are secured in place via a friction fit within the pin apertures. In other embodiments, an adhesive or other bonding material can be used to hold the engagement pins 100 in place. In yet another embodiment, the engagement pins 100 are threaded set screws, and the pin apertures 98 are threaded to receive the pins. Other embodiments can use other techniques for retaining the engagement pins in place.

As best seen in FIGS. 4, 5, 8, and 9, the tremolo assembly 10 has a tremolo arm 110 that is removeably received in the interior bore 70 of the bushing 60. The tremolo arm 110 of the illustrated embodiment has an engagement section 112 that snugly fits into the bushing's interior bore 70, a handle 114 opposite the engagement section 112, and a contoured intermediate section 115 extending therebetween.

In the illustrated embodiment, the engagement section 112 has a partially cylindrical shape with a flattened engagement surface 116. This flattened engagement surface 116 works with the pins 100 in the bushing 60 to act as a keyway arrangement. In an alternate embodiment, the bushing 60 and the engagement section 112 of the tremolo arm 110 can be configured with a keyway having other shapes or configuration while controlling the orientation of the tremolo arm 110 relative to the bushing when the tremolo arm is installed into the bushing. When the tremolo arm 110 is installed into the bushing as shown in FIG. 12, the engagement surface 116 is rotatably oriented to be parallel with the longitudinal axes of the pins 100. Accordingly, the engagement section 112 is not blocked by the pins 100 from extending fully into the interior bore 70. If the tremolo arm 110 is not oriented with the engagement surface 116 parallel to the pins 100, the pins block the engagement section from sliding fully into the interior bore. When the tremolo arm 110 is properly oriented, the engagement section 116 can be smoothly moved axially into and out of the bushing 60.

The tremolo arm's engagement section 112 is sized to closely fit within the interior bore 70, so the engagement surface 116 is in firm engagement with the pins and the rest of the engagement section that contacts the bushing's smooth interior surface 68. Accordingly, the tremolo arm is held in the bushing via a friction fit between the bore's interior surface 68 and the pins 100. The friction fit is tight enough to allow the tremolo arm 110 to be easily pushed into the bushing 60 and retained in place while actively playing the guitar. The friction fit, however, is not so tight as to require excess force or separate tools to install or remove the tremolo arm 110 from the bushing 60.

When the tremolo arm 110 is installed in the bushing, the engagement section 112 and the bushing are rotatable as a unit relative to the tremolo block 28. Accordingly, the tremolo arm 110 can be rotated with the bushing 60 relative to the block 28 and the guitar body 14 so the handle 114 is easily and quickly moveable between a lowered, inactive position, as shown in FIG. 13, and a raised, active or playing position, as shown in FIG. 1. In the illustrated embodiment, the tremolo arm 110 and the bushing 60 are configured to allow the musician playing the guitar 12 to quickly grab the tremolo arm's handle when in the lowered, inactive position and rotate it to the raised playing position. When the musician is finished (or temporarily finished) using the tremolo arm 110, he or she can let go of the handle 114 and the tremolo arm will rotate and drop back to the lowered, inactive position. As indicated above, the bushing 60 and the locking nuts 90 and 92 can be adjusted to control the amount of resistance on the bushing, thereby controlling the force needed to move the tremolo arm between the lowered, inactive position and the raised, playing position.

The tremolo arm 110 is contoured along the intermediate section 115 and the handle 114 so the handle is in a convenient and easy position for the musician to grab and manipulate relative to the guitar. For example, when the tremolo arm 110 is installed and in the raised, playing position (FIG. 1), the musician can hold the handle 114 and move the tremolo arm 110 relative to the guitar body 14, thereby causing bushing 60, the tremolo block 28 and the saddle plate 24 to pivot as a unit about the fasteners 40 that secure the saddle plate 24 to the guitar body 14. This pivoting motion causes the end of the saddle plate 24 with the string apertures 30 to move relative to the guitar body 14, thereby changing the tension in the guitar strings 18, which changes the pitch of the strings. Accordingly, the tremolo arm 110 creates a long lever arm that the musician can use to easily, quickly, and precisely pivot the tremolo assembly 10 to change the pitch of the strings when playing the instrument as to create a vibrato. In the illustrated embodiment, the tremolo arm's engagement section 112 and the bushing 60 are sized to provide a longer and more stable lever arm to cause the pivoting motion of the saddle plate 24, thereby providing better control and accuracy for the musician for creating the vibrato.

The tremolo assembly 10 of the present invention maintains a secure fit and it avoids the drawbacks of a loose or sloppy fit that can be experienced over time with a threaded engagement between components of a tremolo system of the prior art. The tremolo assembly of the present invention also allows the tremolo arm to be quickly and easily installed without having to wind the arm around and around as needed with the threaded systems of the prior art. Accordingly, the tremolo assembly 10 provides a superior tremolo system that resolves inefficiencies and other drawbacks of the prior art.

From the foregoing, it will be appreciated that specific embodiments of the invention have been described herein for purposes of illustration, but that various modifications may be made without deviating from the invention. While embodiments discussed above were configured for use with an electric guitar, the tremolo assembly can be used with other stringed instruments. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

I claim:

1. A bridge assembly for use with a stringed instrument having a plurality of strings, the bridge assembly comprising:

a saddle plate having a first aperture;

a tremolo block attached to the saddle plate, the tremolo block having a second aperture aligned with the first aperture;

a bushing extending through the first and second apertures, the bushing being rotatable relative to the saddle plate and the tremolo block; the bushing having an internal bore with a longitudinal axis and substantially concentric with the second aperture in the tremolo block;

an engagement pin extending through the bushing and being at least partially disposed in the internal bore, the engagement pin being substantially perpendicular to and laterally disposed from the longitudinal axis of the internal bore; and a tremolo arm slidably disposed in the bushing, the tremolo arm having an engagement section that extends into the internal bore of the bushing, a handle portion spaced apart from the bushing and an intermediate section between the engagement section and the handle portion, the handle portion being graspable and movable by a user to change the change pitch of the strings during use, the engagement section has a partially cylindrical shape that closely matches the internal bore and has a flat engagement surface substantially parallel to the longitudinal axis of the internal bore, the flat engagement surface being in firm engagement with the engagement pin, wherein the engagement section can slide longitudinally in the internal bore relative to the engagement pin and the engagement pin blocks the engagement section from rotating relative to the bushing, whereby the tremolo arm is rotatable with the bushing as a unit relative to the tremolo block with no axial movement of the engagement section relative to the tremolo block.

2. The bridge assembly of claim 1 wherein the tremolo arm is moveable between inserted and removed positions relative to the bushing and the tremolo block by axially sliding the engagement section parallel to the first longitudinal axis into and out of the internal bore.

3. The bridge assembly of claim 1 wherein the bushing has an end portion adjacent to the saddle plate and a flange extending radially from the end portion, the flange being rotatably disposed relative to the saddle plate, the flange having an outer diameter less than an inner diameter of the second aperture in the tremolo block.

4. The bridge assembly of claim 3 wherein saddle plate having an upper surface facing away from the tremolo block, and the flange has an end surface substantially coplanar with an upper surface of the saddle plate.

5. The bridge assembly of claim 1 wherein the bushing has an outer diameter and the second aperture in the tremolo block has an inner diameter slightly larger than the outer diameter, wherein the bushing can rotate within the second aperture while being substantially restricted from lateral movement relative to the tremolo block.

6. The bridge assembly of claim 1 the tremolo block has a first end adjacent to the saddle plate and a second end opposite the first end and spaced apart from the saddle plate, the bushing having an end portion adjacent to the second end of the tremolo block, and a locking member is attached to the end portion and securely retains the bushing within the first aperture in the tremolo block while allowing the bushing to rotate therein.

7. The bridge assembly of claim 6 wherein the locking member is a pair of locking nuts screwed onto the end portion of the bushing.

8. The bridge assembly of claim 6 wherein the tremolo block has a top portion adjacent to the saddle plate and a bottom portion opposite the top portion and spaced apart from the saddle plate, the bottom portion having a recessed portion therein that receives the locking member therein.

9. The bridge assembly of claim 1, further comprising a biasing member coupled to the bushing and biasing bushing away from the saddle plate to substantially preventing axial movement of the flange relative to the saddle plate during use.

10. The bridge assembly of claim 1 wherein the engagement pin is a first engagement pin, and the assembly further comprising a second engagement pin substantially parallel to the first engagement pin and extending through the bushing and being at least partially disposed in the internal bore, the first and second engagement pins in frictional engagement with the flat engagement surface of the engagement section of the tremolo arm.

11. The bridge assembly of claim 1 wherein the bushing and tremolo arm can freely rotate relative to the tremolo block under the force of gravity from a first position in which a user is holding the handle portion in a non-vertical orientation to a second position with a generally vertical orientation upon the user releasing the handle portion.

12. A bridge assembly for use with a stringed instrument having a plurality of strings, the bridge assembly configured to receive a tremolo arm having an engagement section with a partially cylindrical shape and a flat engagement surface defining a plane substantially parallel to a longitudinal axis of the engagement section, the bridge assembly comprising:

a saddle plate having a first aperture;

a tremolo block attached to the saddle plate, the tremolo block having a second aperture aligned with the first aperture;

a bushing extending through the first and second apertures, the bushing being rotatable relative to the saddle plate and the tremolo block; the bushing having an internal bore with a longitudinal axis and substantially concentric with the second aperture in the tremolo block; and a pair of spaced apart engagement members extending through the bushing and being at least partially disposed in the internal bore, the engagement members being substantially perpendicular to and laterally disposed from the longitudinal axis of the internal bore, the engagement members in frictional engagement with the flat engagement surface of the tremolo arm's engagement section when the engagement section is disposed in the internal bore, the engagement members being rotatable with the bushing and the tremolo arm's engagement section as a unit relative to the tremolo block.

13. The bridge assembly of claim 12 wherein the bushing has an end portion adjacent to the saddle plate and a flange extending radially from the end portion, the flange being rotatably disposed relative to the saddle plate, the flange having an outer diameter less than an inner diameter of the second aperture in the tremolo block.

14. The bridge assembly of claim 12 wherein the bushing has an outer diameter and the second aperture in the tremolo block has an inner diameter slightly larger than the outer diameter, wherein the bushing can rotate within the second aperture while being substantially restricted from lateral movement relative to the tremolo block.

15. The bridge assembly of claim 12 wherein the tremolo block has a first end adjacent to the saddle plate and a second end opposite the first end and spaced apart from the saddle plate, the bushing having an end portion adjacent to the second end of the tremolo block, and a locking member is releasably attached to the end portion and securely retains the bushing within the first aperture in the tremolo block while allowing the bushing to rotate therein.

16. The bridge assembly of claim 12, further comprising a biasing member coupled to the bushing and biasing bushing away from the saddle plate to substantially preventing axial movement of the flange relative to the saddle plate during use.

17. The bridge assembly of claim 12, further comprising the tremolo arm with the engagement section with the flat engagement surface that slideably engages the engagement members.

18. A method of making a bridge assembly for use with a stringed instrument with a plurality of strings, comprising:

attaching a saddle plate having a first aperture to a tremolo block having a second aperture wherein the first and second apertures are coaxially aligned;

inserting a bushing through the first and second apertures and at into the tremolo block, the bushing being rotatable relative to the saddle plate and the tremolo block, the bushing having an internal bore with a longitudinal axis and substantially concentric with the second aperture in the tremolo block, and an engagement pin extending through the bushing and being at least partially disposed in the internal bore, wherein the engagement pin is substantially perpendicular to and laterally disposed from the longitudinal axis of the internal bore;

securing the bushing in the tremolo block wherein the bushing is restricted from moving axially relative to the tremolo block and is rotatable relative to the tremolo block; and axially sliding an engagement section of a tremolo arm into the internal bore of the bushing, the tremolo arm having a handle portion spaced apart from the bushing and being graspable and movable by a user, the engagement section having a partially cylindrical shape that closely matches the internal bore and having a flat engagement surface substantially parallel to the longitudinal axis of the internal bore, the flat engagement surface being in firm engagement with the engagement pin, wherein the engagement section can slide longitudinally in the internal bore relative to the engagement pin and the engagement pin blocks the engagement section from rotating relative to the bushing.

19. The method of claim 18, further comprising rotating the tremolo arm with the bushing as a unit relative to the tremolo block with no axial movement of the engagement section relative to the tremolo block during the rotation.

20. The method of claim 18, further comprising removing the tremolo arm from the bushing by axially sliding the engagement section of the tremolo arm out of the internal bore, wherein the flat engagement surface slides over the engagement pin during the removal.

* * * * *